US010806225B2

(12) United States Patent
Sitnikova

(10) Patent No.: US 10,806,225 B2
(45) Date of Patent: Oct. 20, 2020

(54) FOLDING CONTAINER BAG

(71) Applicant: California Innovations Inc., Toronto (CA)

(72) Inventor: Elena Sitnikova, Toronto (CA)

(73) Assignee: CALIFORNIA INNOVATIONS INC. (CA)

( * ) Notice: Subject to any disclaimer, the term of this patent is extended or adjusted under 35 U.S.C. 154(b) by 0 days.

(21) Appl. No.: 16/265,263

(22) Filed: Feb. 1, 2019

(65) Prior Publication Data

US 2020/0245735 A1 Aug. 6, 2020

(51) Int. Cl.

| | |
|---|---|
| ***A45C 7/00*** | (2006.01) |
| ***A45C 11/20*** | (2006.01) |
| ***B65D 81/38*** | (2006.01) |
| ***A45C 13/26*** | (2006.01) |
| ***A45C 3/00*** | (2006.01) |
| ***A45C 13/10*** | (2006.01) |

(52) U.S. Cl.

CPC ..... *A45C 7/0077* (2013.01); *A45C 3/001* (2013.01); *A45C 11/20* (2013.01); *A45C 13/103* (2013.01); *A45C 13/26* (2013.01); *B65D 81/3888* (2013.01)

(58) Field of Classification Search

CPC ..... A45C 7/0077; A45C 3/001; A45C 11/20; A45C 13/103; A45C 13/26; B65D 81/3888

USPC ..... 383/2, 4, 110

See application file for complete search history.

(56) References Cited

U.S. PATENT DOCUMENTS

| | | | | |
|---|---|---|---|---|
| 1,524,077 | A * | 1/1925 | Bailey | A45C 3/04 383/2 |
| 1,553,697 | A * | 9/1925 | Lederer | A45C 7/0077 383/2 |
| 1,666,704 | A * | 4/1928 | Hunter | A45C 3/04 383/2 |
| 2,532,778 | A * | 12/1950 | Mintzes | A45C 3/04 383/40 |
| 4,679,242 | A * | 7/1987 | Brockhaus | A45C 3/04 190/1 |
| 5,152,612 | A * | 10/1992 | Shoemaker | A41D 3/00 383/4 |
| 5,316,388 | A * | 5/1994 | Caligiuri | A45C 11/20 383/127 |
| 8,016,090 | B2 * | 9/2011 | McCoy | B65D 81/389 190/107 |

(Continued)

*Primary Examiner* — Jes F Pascua

(74) *Attorney, Agent, or Firm* — Ostrolenk Faber LLP

(57) ABSTRACT

A folding container assembly has a soft-sided wall structure that is collapsible from either a fully expanded condition or from a partially expanded condition, wherein the container assembly defines an interior chamber for storing articles, into a carry pouch format wherein the container assembly is folded down on itself such that the interior chamber of the container assembly is not accessible for use. Accordingly, the folding container assembly has a first configuration wherein the container assembly defines a first interior cavity having a first interior volume for storing articles, a second configuration wherein the container assembly defines a second interior cavity having a second interior volume, wherein the second interior volume is less than the first interior volume, and a third configuration wherein the container assembly is folded down on itself into a compact form such that the interior cavity or chamber is not accessible for use.

21 Claims, 7 Drawing Sheets

(56) References Cited

U.S. PATENT DOCUMENTS

| | | | | |
|---|---|---|---|---|
| 2004/0136621 | A1* | 7/2004 | Mogil | A45C 7/0077 383/110 |
| 2005/0117817 | A1* | 6/2005 | Mogil | A45C 7/0077 383/110 |
| 2006/0198562 | A1* | 9/2006 | Mogil | A45C 7/0077 383/121.1 |
| 2007/0274613 | A1* | 11/2007 | Pruchnicki | A45C 7/0077 383/110 |
| 2011/0142373 | A1* | 6/2011 | Kong | B65D 33/00 383/6 |
| 2012/0057809 | A1* | 3/2012 | Buller | A45C 7/0077 383/2 |
| 2017/0127777 | A1* | 5/2017 | Cohen | A45C 13/1076 |

* cited by examiner

FOLDING CONTAINER BAG

FIELD OF THE INVENTION

This invention relates to the field of portable containers or bags, in particular, insulated portable containers or bags.

BACKGROUND OF THE INVENTION

Portable containers or bags that reduce the need for single use plastic bags have increased in popularity. As well, portable insulated containers or bags have also become popular for carrying either articles that may best be served cool, such as beverages or salads, or warm, such as appetizers, and so on.

Soft-sided insulated containers have the advantage of being relatively light, and so therefore relatively easily carried, and relatively forgiving in terms of tending not to impart damage to the objects placed within them. Often such containers are used for carrying children's lunches, as when at school. Other such containers may be used when going shopping at the grocery store or market, or when going on a picnic or to the beach.

Soft sided insulated containers are manufactured in several different configurations. One style of configuration is the portable tote bag. Such bags often have a pair of handles such as may be carried by hand, or over a shoulder. There may be times when a tote bag is larger than may be needed or convenient, and the user may wish for a smaller configuration. At other times, when the tote bag is empty, it may be seen as a large and floppy encumbrance, where a small, more compact package would be more suitable.

For example, once the packed lunches or other food items have been consumed or delivered or otherwise removed from the container or bag, carrying a full-sized soft-sided insulative container or bag may be inconvenient. A soft-sided insulated containers or bag that may be conveniently stored away and that is convertible between various sizes, such that a single soft-sided insulated container may be employed for various uses is desirable. The present inventor provides a soft-sided folding container or bag that may address these issues.

SUMMARY OF THE INVENTION

In an aspect of the present disclosure there is a folding container bag that is deployable in a first configuration in which the folding container bag defines a first interior volume and a second configuration in which it defines a second interior volume, the second interior volume being reduced relative to the first interior volume.

In another aspect of the invention, there is a soft-sided insulated container. It has a first wall, a second wall, a bottom wall, and a retainer. At least the first and second walls are insulated walls. The first wall is a front wall. The second wall is a rear wall. The first wall, second wall, and bottom wall co-operate to define a chamber of a first capacity in which to place objects. It has a closure distant from the bottom wall. The retainer is mounted to the first wall. The retainer is located outside the chamber. The first wall, second wall and bottom wall are foldable to a first position. In the first position the first wall lies between the retainer and the second wall. At least the bottom wall and at least a portion of the front wall and the rear wall are movable to a second position in which the bottom wall and at least a portion of the second wall lie between the retainer and the first wall. In the second position the chamber of the soft-sided insulated container has a second capacity, the second capacity is smaller than the first capacity.

In a feature of that aspect, the first wall has an inside surface that faces the second wall, and an outside surface that faces the retainer. The retainer has a first surface and a second surface. In the first position, the first surface of the retainer faces the first surface of the first wall. In the second position, the second surface of the retainer faces the first wall, and the first surface of the retainer faces outwardly and away from the first wall. In another feature, in the second position, the inside surface of the first wall faces toward the retainer, and the second wall is between the inside surface of the first wall and the retainer.

In a further feature, the retainer is a web. In a still further feature, the retainer is uninsulated. In another feature, the retainer is a web mated to the first wall to define a reversible pouch. In another feature, in the second position, the pouch is in turned inside-out relative to the first position, and, when the pouch is turned inside-out, the bottom wall and at least a portion of the second wall are contained within the pouch. In an additional feature, in the second position, at least a portion of the first wall is also contained within the pouch. In another feature, the bottom wall is a folding wall. In a yet further additional feature, the first wall and the second wall have respective lower margins distant from the closure. In the first position, the first wall projects onto the second wall, and the bottom wall is folded between the respective lower margins if the first and second walls.

In another feature, the container has a securement. The soft-sided insulated container is foldable from the first position to a first folded storage configuration. The soft-sided insulated container is foldable from the second position into a second folded storage configuration. The second folded storage configuration is different from the first folded storage configuration. The securement is operable to hold the soft-sided insulated container in each of the first folded storage configuration and the second folded storage configuration. In an additional feature, the retainer is a web extending from side to side of the first wall. The web has a lowermost margin secured to the first wall. The web has an uppermost margin distant from the lowermost margin;

the uppermost margin defining a free edge. A pouch is defined between the web and the first wall. The pouch is invertible to an inside-out position. The securement has the form of a flap mounted to the free edge of the web. In a yet additional feature, in the first position, the soft-sided insulated container has the form of a first tote-bag configuration. In the second position, the soft-sided insulated container has the form of a second tote-bag configuration. The second tote bag configuration is smaller than the first tote-bag configuration. In each of the first folded storage position and the second folded storage position the flap is folded over the soft-sided insulated container, and the soft sided-insulated container has a purse-shaped configuration. In another feature, in the purse-shaped configuration, the side margins of the first wall are folded toward each other; and the soft-sided insulated container is folded over on itself four times in the direction of height; and the side margins of the first wall are concealed behind the flap.

In another feature, the retainer is a web extending spanwise across the first wall and has a free edge, the free edge also extending spanwise. In moving between the first position and the second position, the web is inverted. The container has a securement mounted to the free edge of the web. The container is foldable from the first position into a first folded storage position. The container is foldable from the second position into a second folded storage position different from the first folded storage position. The securement is operable to hold the soft-sided insulated container in each of the first folded storage position and the second folded storage position. In another feature, the retainer is a web extending spanwise across the first wall and has a free edge, the free edge also extending spanwise. The web is co-operable with the first wall to define a pouch. The pouch is invertible. In moving between the first position and the second position, the web is inverted. The container has a first pouch securement and a second pouch securement mounted to the free edge of the web. In the first position, the first pouch securement engages the first wall to close the pouch. In the second position the pouch is inverted, and the second pouch securement engages the second wall to close the pouch.

In another feature, the first wall and the second wall are joined along mutual side edges. The retainer is a web extending spanwise across the first wall, and has corresponding side edges joined to the respective side edges of the first wall. The first wall has an upper margin proximate the closure, and a lower margin distant from the closure. The web has a lower margin that runs across the first wall, the lower margin of the web is spaced upwardly of the lower margin of the first wall. The web has an upper margin that runs across the first wall. The upper margin of the web is spaced downwardly of the upper margin of the first wall. The upper margin of the web is a free edge. In another feature, the first wall has a height, H, from the lower margin thereof to the upper margin thereof; the web has a height, h, between the lower margin thereof and the upper margin thereof; and a ratio of h:H lies in the range of ⅖ to ⅗.

In another feature, the closure has a lineal length L, the bottom wall has a length running transverse to the first wall, and a width running between the first wall and the second wall, the length of the bottom wall is greater than the width of the bottom wall; and the length of the closure is greater than the length of the bottom wall. In still another feature, the first wall, the second wall and the bottom wall are insulated. Each of the first wall and the second wall includes an outside layer, and inside layer, and a layer of insulation captured between the inside layer and the outside layer. The closure of the soft-sided insulated container is a tracked fastener running along the upper margins of the first wall and the second wall. The bottom wall is a bi-folding bottom wall. The retainer is an un-insulated web, the web and the first wall has mutually mated side edges, the web and the first wall defining an inside-out invertible pouch.

In another aspect, there is a folding container assembly. It has a folding container wall structure having a bottom panel, first and second opposed, spaced apart wall panels. The bottom panel, the first wall panel and the second wall panel cooperate to define an interior chamber in which to place objects. A conversion panel is mounted to an outer surface of the first wall panel and extends across the first wall panel such that side edges of the conversion panel are connected to the first wall panel. The conversion panel has a first side face-to-face with the outer surface of the first wall panel, a second side opposite to the first side, an upper, free edge and a bottom edge connected to the first wall panel. The conversion panel has a bottom edge located upwardly of, and distant from, a bottom edge margin of the first wall panel. The free edge is located lower than, and distant from, an upper edge margin of the front wall panel. The folding container assembly is movable between first and second configurations. In the first configuration the wall structure defines an interior chamber, and the conversion panel defines an open-top pocket between the first side of the conversion panel and the outer surface of the first wall panel. In the second configuration the conversion panel is positioned such that the second side of the conversion panel is in face-to-face relationship with the outer surface of the second wall panel such that the conversion panel defines an open-top pocket between the second side of the conversion panel and the outer surface of the second wall panel. In the second configuration the interior chamber is reduced in size relative to the first configuration.

In a feature of that aspect, the folding container assembly is deployable in a third configuration. In the third configuration the wall structure is collapsed and folded on itself such that the interior chamber is inaccessible for receiving objects. In another feature, a first variation the folding container assembly is convertible into the third configuration via a series of folding steps from the first configuration. A second variation of the folding container assembly is convertible into the third configuration via a series of folding steps from the second configuration. In another feature, the first wall panel, the bottom panel and the second wall panel are of unitary one piece construction. In another feature, the first wall panel has side edge margins and the second wall panel has side edge margins. The first wall panel side edge margins mate with the second wall panel side edge margins to define the open-top interior chamber.

In still another feature, the first wall panel has a bottom edge margin mating with a first longitudinal margin of the bottom panel. The upper edge margin of the first wall panel extends parallel, or substantially parallel, to the bottom margin but distant therefrom. The second wall panel has a bottom edge margin mating with a second longitudinal margin of the bottom panel. The upper edge margin of the second wall panel extends parallel or substantially parallel to the bottom margin and distant therefrom. The first wall panel has side edge margins and the second wall panel has side edge margins. The first wall panel side edge margins mate with the second wall panel side edge margins to define the pair of closed side walls. In a further feature, the bottom panel has a central, longitudinal fold line. The central, longitudinal fold line permits folding of the bottom panel such that a first half of the bottom panel is on top of and in parallel, or substantially parallel, relationship with a second half of the bottom panel such that the container assembly collapses to a flattened state.

In still another feature, the assembly is converted and has a bottom portion of the container assembly extending between the sewn seam defined by connection of the bottom edge of the conversion panel to the first wall panel and the bottom panel. A top portion of the container assembly extends between the upper, free edge of the conversion panel and the upper edge margins of the first and second wall panels. During conversion of the folding container assembly from the first configuration to the second configuration the bottom portion of the container assembly is folded upward relative to the bottom edge of the conversion panel such that the outer surface of the first wall panel of the bottom portion of the container assembly is in face-to-face relationship with the with second side of the conversion panel. The conversion panel is reversed about its bottom edge. The folded bottom portion is then located between the second side of the conversion panel and the outer surface of the second wall panel. In an additional feature, the wall structure includes a releasable securement operable to hold the folded bottom portion of the container assembly relative to the outer surface of the first wall panel. In a further additional feature, the releasable securement has a securing flap has a root edge secured to the upper free edge of the conversion panel. The flap is hingedly connected to the conversion panel at the root edge. In another feature, the securing flap includes a first part of a releasable fastening device that cooperates with a corresponding second part of a releasable fastening device located on a corresponding portion of the wall structure.

In another additional feature, the securing flap has a pair of side portions of the container assembly, each side portion extending between a respective side edge of the securing flap and a corresponding side edge margin of the wall structure. The folding container assembly is movable from the second configuration to the third configuration in which each side portion is folded backward away from the conversion panel such that they lie against the first side of the first wall panel. The upper edge margins of the first and second wall panels are folded downward to define an upper fold line. The bottom edge is folded upward such that the bottom edge overlaps and lies against the upper fold line. The securing flap extends over the upper fold line and the bottom edge and is operable releasably to hold the folding container assembly in the third configuration.

In still another additional feature, the location of the securing flap relative to the conversion panel of the wall structure defines a pair of side portions of the container assembly. Each side portion extends between a respective side edge of the securing flap and a corresponding side edge margin of the wall structure. In conversion of the folding container assembly from the first configuration to the first variant of the third configuration, each side portion is folded backward away from the conversion panel such that they become disposed against the second wall panel. The upper edge margins of the first and second wall panels are folded downward away from the upper free edge of the conversion panel to define an upper fold line. The bottom edge of the container assembly is folded upward away from the conversion panel such that the bottom edge meets the folded down upper edge margins of the first and second wall panels thereby defining a bottom fold line. The bottom fold line is folded upward to overlap the folded down upper edge margins of the first and second wall panels, the bottom fold line is brought into alignment with the upper fold line. The securing flap extends over the upper fold line and the bottom edge and is operable releasably to hold the folding container assembly in the first variant of the third configuration.

In still another feature, the upper edge margins of the first wall panel and the second wall panel include a closure member operable releasably to fasten the upper edge margins of the first and second wall panels in a closed condition. The folding insulated container assembly has pull loops at respective bottom corners of the bottom edge of the conversion panel. The pull loops are located between the first side of the conversion panel and the outer surface of the first wall panel when the folding insulated container is in the first configuration. The pull loops are at respective bottom corners of the outside of the foldable insulated container when the folding insulated container is in the second configuration. In an additional feature, the closure member includes a tracked fastener, and the closure has a length-to-width ratio that is greater than a corresponding length-to-width ratio of the bottom panel. In still another feature the folding wall structure is an insulated wall structure the bottom panel. The first wall panel and the second wall panel each include an outer skin, an inner skin and a layer of thermal insulation captured between the outer skin and the inner skin. In another feature, the assembly has a carry handle disposed at the upper edge margins of the first and second wall panels.

In another aspect of the invention there is a foldable soft-sided insulated container. It has a first insulated wall panel; a second insulated wall panel; a bottom wall panel; a conversion panel; and a securement flap. The first insulated wall panel defines a front wall of the soft-sided insulated container. The second insulated wall panel defines a rear wall of the soft-sided insulated container. The first and second insulated wall panels each has a respective outside skin, an inside skin, and a layer of insulation captured between the inside and outside skins. A first margin mated to the bottom panel, and a second margin distant therefrom; a first side edge margin is mated to a corresponding first side edge margin of the other one of the first and second insulated wall panels. A second side edge margin distant from the first side edge margin mated to a corresponding second side edge margin of the other one of the first and second insulated wall panels. The conversion panel is mounted outside of the outside skin of the first wall panel. The conversion panel has a lower edge and an upper edge and is located relative to the outside skin of the first wall panel such that the lower edge is disposed closer to the lower margin of the first wall panel than is the upper edge. The upper edge is a free edge. The securement flap is secured to the upper free edge of the conversion panel such that the securement flap is movable between a first position and a second position. In the first position the securement flap overlies a second side of the conversion panel. In the second position the securement flap over-reaches the upper margins of the first wall panel and the second wall panel. The soft-sided insulated container is movable between a first configuration, a second configuration and a third configuration. In the first configuration the first insulated wall panel, the second insulated wall panel, the bottom wall panel and the conversion panel cooperate to define an interior chamber has a first internal volume. The conversion panel defines a pocket between a first side of the conversion panel and the outer skin of the first wall panel. The pocket has a closed bottom corresponding to the lower edge of the conversion panel located above and distant from the bottom panel. In the second configuration the first insulated wall panel, the second insulated wall panel, the bottom wall panel and the conversion panel cooperate to define a second configuration of the interior chamber has a second internal volume that is reduced relative to the first internal volume. The second configuration internal chamber has a base defined by the lower edge of the conversion panel. The conversion panel defines a pocket between a second side of the conversion panel and the outer skin of the second wall panel. The pocket has a closed bottom defined by the lower edge of the conversion panel. In the third configuration the internal chamber is inaccessible for storing articles. In the third configuration the foldable insulated container is folded to a width and a height that are less than in the first configuration and less than in the second configuration.

In a feature, the foldable insulated container is convertible into a first variant of the third configuration when the foldable insulated container is in the second configuration and is convertible into a second variant of the third configuration when the foldable insulated container is in the first configuration. In another feature, the foldable insulated container is in the first variant of the third configuration. The first insulated wall panel; the second insulated wall panel; the bottom wall panel; and the conversion panel of the second configuration foldable insulated container are folded relative to one another. As folded, the mated first side edge margins of the first and second wall panels meet the mated second side edge margins of the first and second wall panels along a central vertical axis of the foldable insulated container. The second margins of the first and second wall panels are folded downward away from the conversion panel defining an upper fold line. The closed bottom of the pocket defined by the conversion panel is folded upward away from the conversion panel to overlap the upper fold line. The securement flap extends over the upper fold line and the closed bottom of the pocket, and is operable to releasably secure the foldable insulated container in the first variant of third configuration. In a further feature, in the second variant of the third configuration, the first insulated wall panel, the second insulated wall panel, the bottom wall panel, and the conversion panel of the first configuration are folded relative to one another such that the mated first side edge margins of the first and second wall panels meet the mated second side edge margins of the first and second wall panels along a central vertical axis of the foldable insulated container. The second margins of the first and second wall panels are folded downward away from the first configuration conversion panel defining an upper fold line and the first margins of the first and second wall panels are folded upward away from the first configuration conversion panel defining a lower fold line, the first margins of the first and second wall panels is brought to meet the second margins of the first and second wall panels. The lower fold line is folded upwards again such that it overlaps the upper fold line. The securement flap extends over the overlapping upper fold line bottom fold line and is operable releasably to secure the foldable insulated container in the second variant of the third configuration.

The features of the aspects of the invention may be mixed and matched as appropriate without need for multiplication and repetition of all possible permutations and combinations.

BRIEF DESCRIPTION OF THE DRAWINGS

These and other aspects and features of the invention may be more readily understood with the aid of the illustrative Figures below, showing an example, or examples, embodying the various aspects and features of the invention, provided by way of illustration, and in which.

DETAILED DESCRIPTION

Figure 1B:
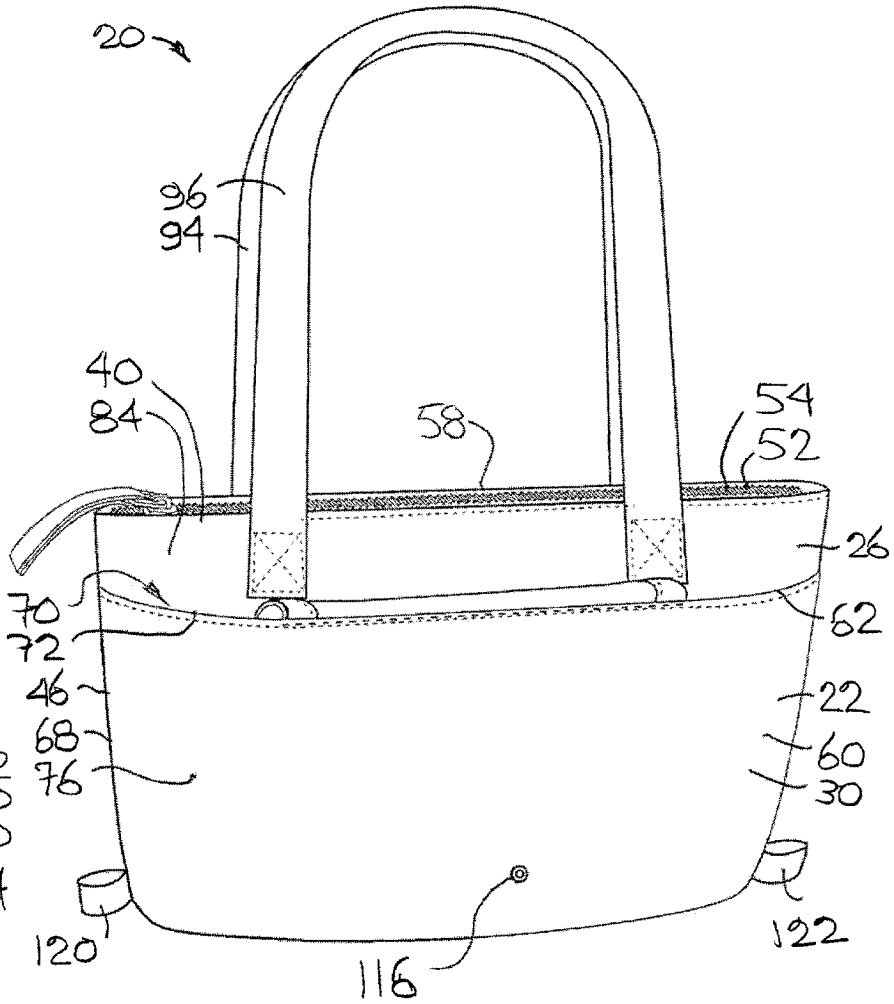
FIG. 1*b* shows a perspective view from in front, to one side and above of an example of the soft-sided container assembly or bag of FIG. 1*a* in a partially expanded condition, position, or second configuration.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals.

For the purposes of this description, it may be that a Cartesian frame of reference may be employed. In such a frame of reference, the long, or largest, dimension of an object may be considered to extend in the direction of the x-axis, the base of the article, where substantially planar, may be considered to extend in an x-y plane, and the height of the article may be measured in the vertical, or z-direction. In other contexts, the z-direction may be the through thickness of a substantially planar panel where the major dimensions lie in the x- and y-directions. The largest container panels herein may be designated arbitrarily as either the front and rear sides or top and bottom sides, faces, or portions of the container. Similarly, the closure member, or opening is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally also be used to aid in keeping food, beverages, or other objects either warm or hot as well as cool, cold, or frozen.

The drawings are substantially to scale, except where noted otherwise, such as in those instances in which proportions may have been exaggerated in order more clearly to depict certain features. In the context of the present description, the x and z dimensions of length and height of the major panels of the containers are approximately in proportion. However, inasmuch as the description refers to webs, layers and skins, that are may be difficult to see when drawn to scale in side view, the through-thickness dimensions in the y-direction, as in FIGS. 6*e*-6*h* and 7*e*-7*h* have been exaggerated in the hope of aiding understanding.

In this specification reference is made to insulated containers. The adjective "insulated" is intended to be given its usual and normal meaning as understood by persons skilled in the art. It is not intended to encompass single layers, or skins, of conventional webbing materials, such as Nylon (t.m.), woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Definitions provided herein are intended to conform to the customary and ordinary meaning of the term "insulated". The Applicant also explicitly excludes cellophane, waxed paper, tin foil, paper, or other single use disposable (i.e., not intended to be re-used) materials from the definition of "washable".

Similarly, this description may tend to distinguish hard shell containers from soft-sided containers. In the jargon of the trade, a soft-sided cooler, or bag, or container, is one that does not have a substantially rigid, high density exoskeleton. A typical example of a container having a hard exoskeleton is one having a molded external shell, e.g., of ABS or polyethylene, or other common types of molded plastic. Rather, a soft-sided container may tend not to be substantially rigid, but may rather have a skin that is flexible, or crushable, or sometimes foldable. By way of an example, which is not intended to be exhaustive, comprehensive, exclusive or limiting, a soft-sided cooler may have an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. In some examples, a soft-sided container may still be a soft-sided container where, as described herein, it may include a substantially rigid liner, or may include one or more battens (which may be of a relatively hard plastic) concealed within the soft sided wall structure more generally, or where hard molded fittings may be used either at a container rim or lip, or to provided a base or a mounting point for wheels, but where the outside of the assembly is predominantly of soft-sided panels. The term "soft-sided" is intended to have the ordinary and customary meaning of the term as understood by persons of ordinary skill in the art in the industry, and as used herein.

Figure 1A:
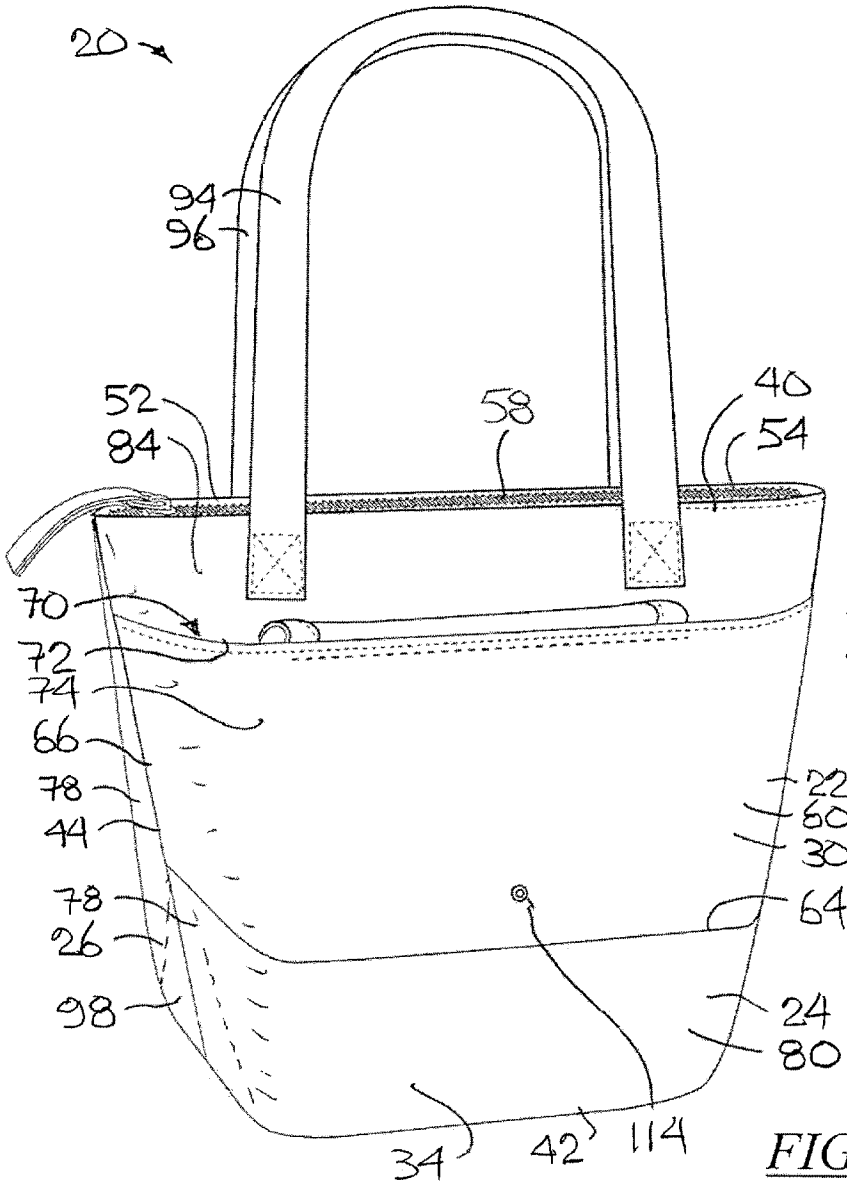
FIG. 1*a* shows a perspective view from in front and to one side of an example embodiment of a collapsible soft-sided container assembly or bag in a fully expanded condition or first configuration.

In FIGS. 1*a*, 1*b*, FIGS. 2*a*-2*e* and FIG. 3, a soft-sided insulated container, or container assembly, or bag, however it may be called, is indicated generally as 20. Container assembly 20 may be, and in the illustrated embodiment is, a foldable, soft-sided, insulated container assembly. FIG. 1*a* shows soft-sided insulated container bag 20 in a first, full sized, configuration. FIG. 1*b* shows soft-sided insulated container 20 in a second, reduced size, or "half size" configuration. The configuration of FIG. 1*b* may be referred to as "half sized" whether or not it is precisely one half the size of the configuration of FIG. 1*a*. It is, in any case, a substantially reduced-size configuration. Soft-sided insulated container 20 may also be folded from the configurations of FIGS. 1*a* and 1*b* to the fully folded storage configurations of FIGS. 6*d* and 7*d* respectively.

As may be noted, in the fully unfolded, or half-sized configurations of FIGS. 1*a* and 1*b* soft-sided insulated container assembly 20 has a tote-bag shape or tote bag configuration. That is to say, the bag has two dominant side panels and is much taller and wider than thick. The tote-bag configuration may be contrasted with a more box-shaped or cuboid configuration in which the through-thickness of the container is of a comparable magnitude to one of the other dimensions, be it length or height. The top of container 20 is closed by a linear closure such as a zipper. Carrying straps permit container assembly 20 to be carried by hand, or over the shoulder. By contrast, in either of the fully folded storage configurations of FIGS. 6*d* and 7*d*, container assembly 20 has been folded to a purse-shape in which the covering flap extends over the front of the compact, folded body of container assembly 20. As folded, the side edges of container assembly 20 have been folded inward toward each other, and the main portion of the container has been multiply folded upwardly on itself in the height direction. As folded, container 20 is about half its unfolded width, and about ¼ of its unfolded height, forming a compact package of roughly the size and shape of a purse (roughly 10"-12"× 5"-6"×2"-3", more or less).

Figure 3:
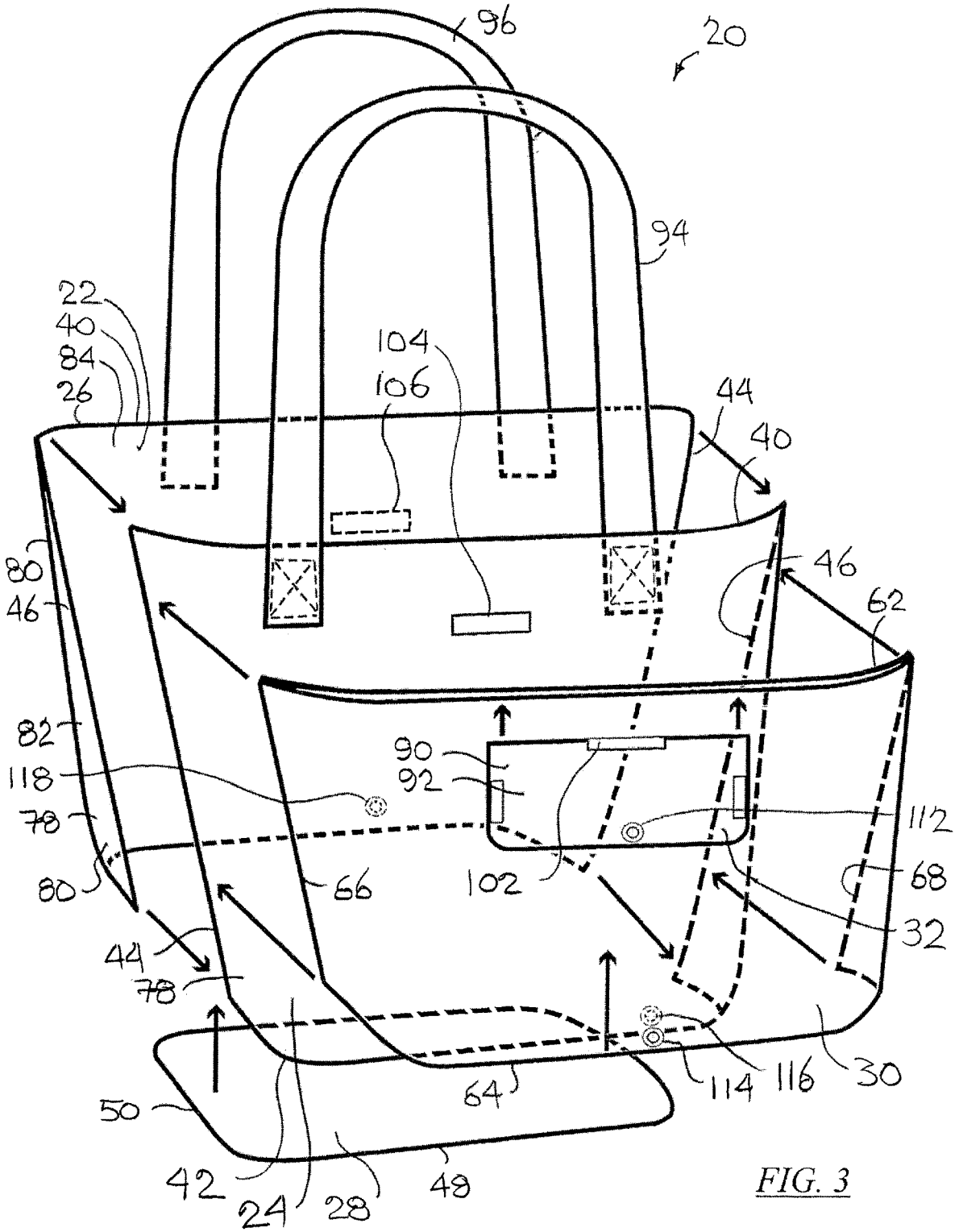
FIG. 3 shows a simplified exploded view of the major components of the structure of the container assembly of FIG. 1*a;*

FIG. 3 shows the elements from which the structure of the bag, or container, 20, is assembled. Container assembly 20 includes a body 22 that has a first panel or first wall 24; a second panel or second wall 26; a bottom panel or bottom wall 28; and a retainer 30. There is also a securement 32.

First wall 24 may be arbitrarily designated as the "front wall", and second wall 26 may be designated as the "rear wall". Although they need not be the same size and shape, it is convenient that they may be, and in the embodiment illustrated they are, the same size and shape, such that the projected profile of first wall 24 projects onto the corresponding profile of second wall 26. Each of walls 24 and 26 has an outer or outside layer or skin, 34, an inner or inside layer or skin 36, and a layer of insulation 38 captured between the inner and outer skins. Although a clear or white vinyl, or other web material could be used, in the embodiment shown the inside surface of the inner layer or skin 36 may have a plasticized metallic (or metallicized plastic) surface such that it is reflective, and is sometimes referred to as a "foil" surface, i.e., because it is reflective in the general manner of the shiny side of aluminum foil. Each of walls 24, 26 has an upper margin, 40, a lower margin 42, a left hand margin or side 44 and a right hand margin or side 46.

Bottom panel or bottom wall 28 is similarly constructed, having an outer skin 34, inner skin 36, and layer of insulation 38 as well. Bottom wall 28 may be rectangular and may be substantially longer than wide. That is, the length of the long margins or edges or sides 48 of bottom wall 28 may be longer than the short margins or edges or sides 50. In the embodiment shown, the ratio of lengths may be 2:1, or roughly 2:1. Bottom panel or bottom wall 28 may be a folding wall. In the embodiment shown it is a bi-folding panel with the fold line 40 running centrally along the middle of the panel parallel to the long side edges 48.

On assembly, bottom or lower margins 42 are joined to the margins or edges 48, 50 of bottom wall 28, each lower margin 42 having a length equal to half the total periphery of bottom wall 28. They may be joined together at sewn seams. Left hand and right hand edges or sides 44, 46 are also sewn together. The top, upper, or uppermost margins of first and second walls 24, 26 combine to form the periphery of main opening 58 of container assembly 20 generally. Margins 40 of walls 24, 26 come together at a closure 52. Closure 52 may have, or may include, a closure member or fitting 54, which may be a tracked fastener, such as a zipper. First and second walls 24, 26 and bottom wall 28 thereby co-operate as a soft-sided, insulated, wall structure that defines a chamber 56 therewithin in which to receive objects that one may wish to keep warm or cool. Closure 52 is movable between open and closed conditions or positions to govern the entry and exit of objects to and from internal chamber 56 through opening 58.

Retainer 30 could be a mesh, or net, or band, or skirt, or web. In the container assembly illustrated, retainer 30 is shown as having the form of a web 60. Web 60 has an upper edge or upper margin 62, lower edge or lower margin 64, a left-hand margin or edge or side 66 and a right-hand margin or edge or side 68. Web 60 can be, and in the embodiment shown is, a continuous sheet of fabric or plastic, e.g., a sheet of nylon (t.m.) that has only a single layer, and that need not be, and in the embodiment shown is not, insulated.

Retainer 30, i.e., web 60, extends cross-wise from side to side of first wall 24. Side edges 66, 68 of retainer 30 run along, and are joined together with the corresponding side edges 44, 46, e.g., at common seam, that seam being also the side seam sewn between first wall 24 and second wall 26. The lower edge or margin 64 of retainer 30 is attached to, and runs across, the outside face of outer skin 34 of first wall 24. In the embodiment shown, edge or margin 64 is spaced upwardly from the bottom edge or margin 42 of first wall 24. The upper edge or margin 62 of web 60 is a free edge, such that objects may be tucked between edge 62 and outer skin 34 of first wall 24, as seen, for example, in FIG. 5*f*. When web 60 is mounted in this way to first wall 24, the walls of an accommodation or pocket or pouch 70 are defined by web 60 and first wall 24, the opening of pouch 70 being indicated as 72. Pouch 70 is reversible, or invertible, such that it may be turned inside-out.

In the drawings, web 60 has a first face 74 and a second face 76. In FIG. 1*a*, first face 74 is facing outward, which is to say away from, first wall 24; second face 76 is facing inward, which is to say toward, first wall 24. In that configuration, first wall 24 is closer to web 60 than is second wall 26, the two being face-to-face. By contrast, in FIG. 1*b*, pouch 70 has been inverted, i.e., turned inside-out such that first face 74 is facing inward, toward first wall 24; and second face 76 is facing outward, away from first wall 24. In this configuration, a portion of the container wall structure, in this instance folded bottom wall 28 and the lowermost portions of second wall 26 and first wall 24 have been tucked or folded into the accommodation of pouch 70, and the main portion of second wall 26 lies between first wall 24 and web 60. When folded in this way, it is still possible to place objects in chamber 56, however, the size of chamber 56 in the configuration of FIG. 1*b* is smaller than it is in the configuration of FIG. 1*a*. It is the same width as before, but the length of the chamber in the vertical direction has been reduced by the amount of material folded up into the bottom of accommodation or pouch 70. In the embodiment shown, the second embodiment may be termed "half size", or reduced size.

Figure 2D:
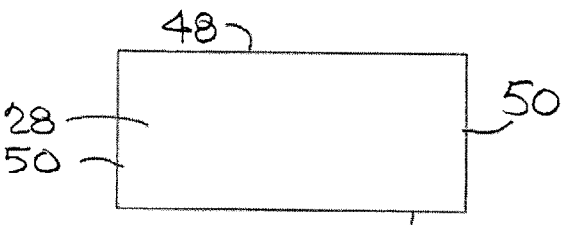
FIG. 2*d* shows a bottom view of the soft-sided container assembly or bag of FIG. 2*b;*
Figure 2C:
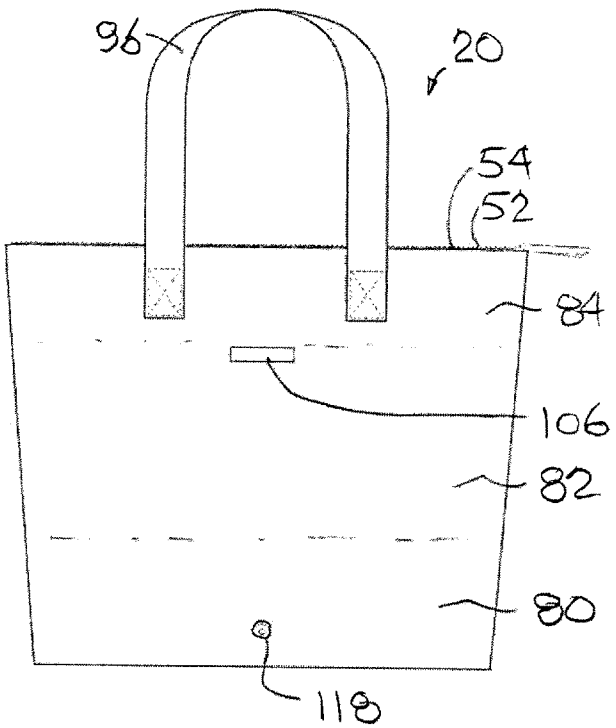
FIG. 2*c* shows a rear or back view of the soft-sided container assembly or bag of FIG. 2*a;*
Figure 2E:
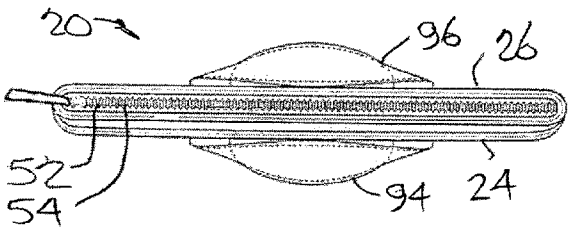
FIG. 2*e* is a top view of the soft-sided insulated container assembly of FIG. 2*a;*
Figure 2B:
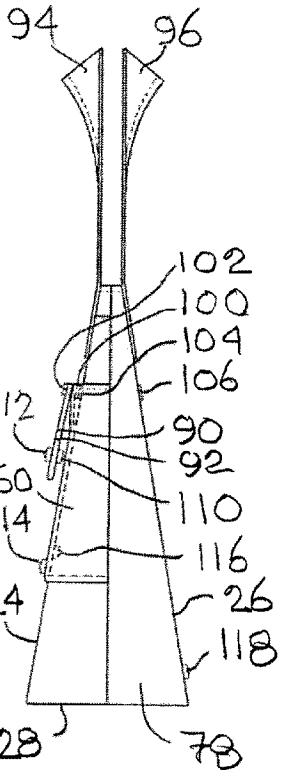
FIG. 2*b* shows a right-hand side or end view of the soft-sided container assembly of FIG. 2*a*, the right and left hand end views being the same but of opposite hand with the securing flap in a folded position over the front of the container assembly.
Figure 2A:
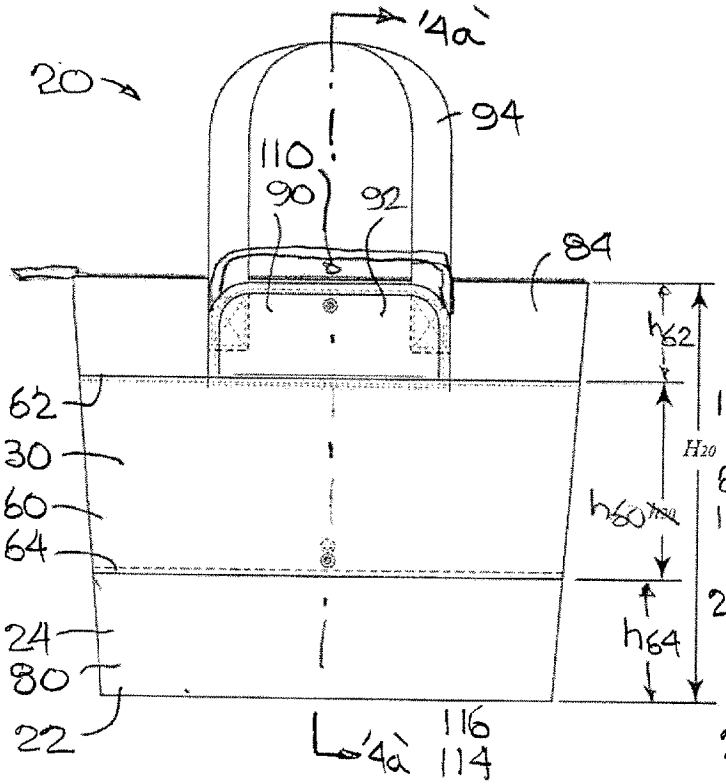
FIG. 2*a* shows a front view of the soft-sided container assembly or bag of FIG. 1*a* with a securing flap in an upright or upstanding position.

As may be noted, the height, $h_{60}$, of web 60 is less than the height $H_{20}$ of first wall 24, and of container assembly 20 more generally, when container assembly 20 is in its fully unfolded condition, position, or configuration. That height is approximately half, i.e., the ratio of $h_{60}$:$H_{20}$ is 1:2. That number may not be exact, and it may conveniently lie in the range of about ⅖ to ⅗ or about ⅜ to ⅝. It may also be noted, as seen in FIGS. 2*a* and 2*b*, that the bottom edge seam of web 60 to front wall 24 is spaced upwardly from the bottom margin of first wall 24. In the embodiment shown, this distance, $h_{64}$, is about 3/10 of $H_{20}$, and, as a ratio, may lie in the range of about ¼ to ⅜, or about ⅔ to ⅓ of $H_{20}$. Similarly too, the upper edge, namely free edge 62, is located downwardly of upper margin 40 of first wall 24 by a distance indicated as h62. This distance, $h_{62}$ may be in the range of about ⅐ to ¼ of $H_{20}$, and may be about ⅙ to ⅕ of $H_{20}$, as in the embodiment illustrated. The lower region of wall 24 (and of wall 26) below edge 64, is identified as 80. The middle region, which is concealed by web 60 in FIG. 1*a*, is identified as 82. The upper or top region between margin 62 and closure 52 is identified as 84.

Container assembly 20 also has a securement 90 which may have, and in the Figures does have, the faun of a closure, or closure flap 92. Securement 90 is mounted to free edge 62 of web 60. The lifting straps are indicated as 94 (attached to the upper margin or region 84 of first wall 24) and 96 (attached to upper margin or region 84 of second wall 26). Two vertical fold lines are indicated as 86 and 88. They are located immediately laterally outboard of the side margins of flap 92 and the laterally outside edges of the handle mounting roots of straps 94 and 96.

Figures 4A, 4B, 4C, 4D:
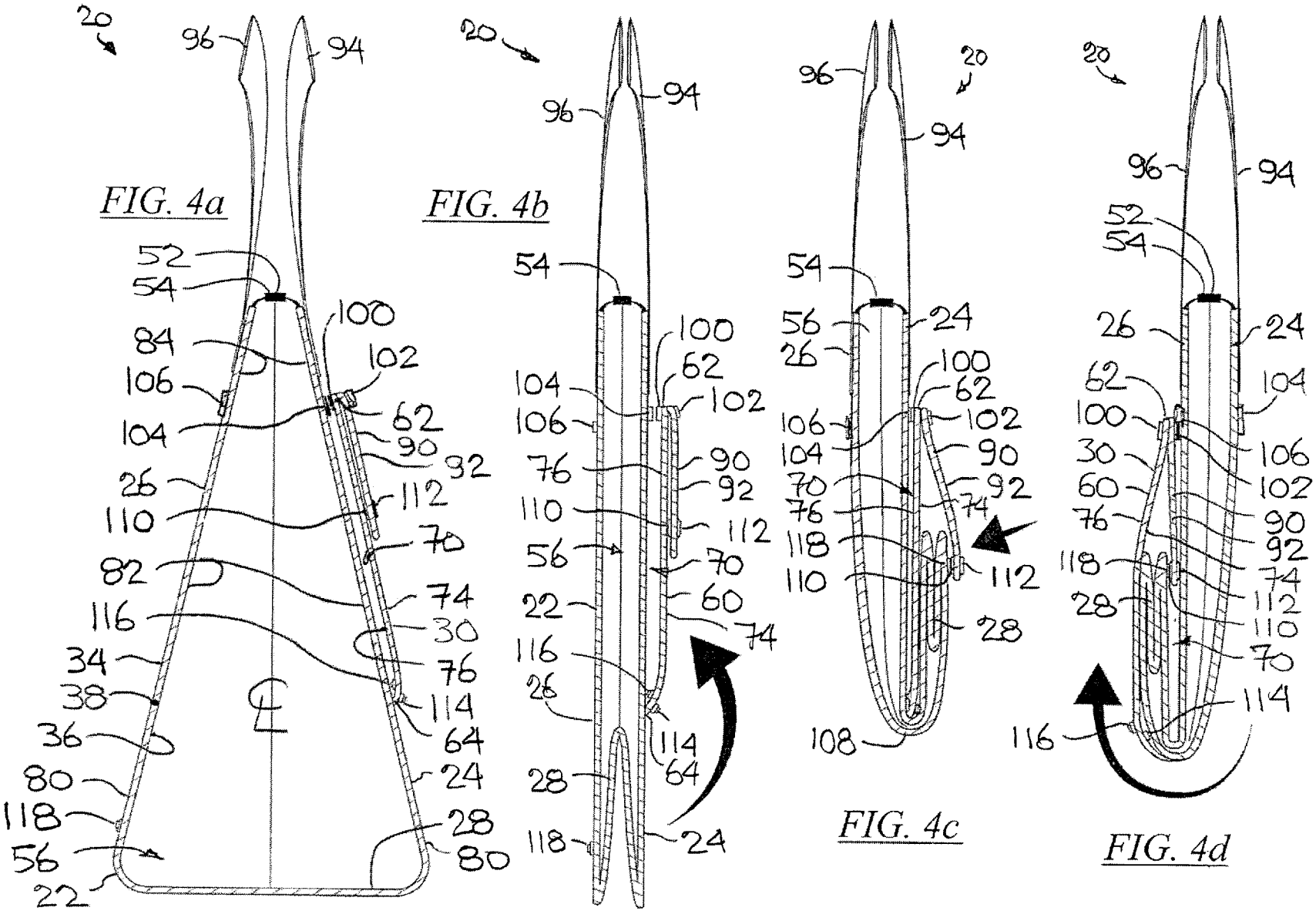
FIG. 4*a* shows a view of the soft-sided container assembly or bag of FIG. 1*a*; taken on section '4*a*-4*a*' of FIG. 2*a;*
FIG. 4*b* shows the soft-sided container assembly or bag of FIG. 4*a* with a bi-folded bottom panel tucked in on itself or disposed in a retracted state.
FIG. 4*c* shows the soft-sided container assembly or bag of FIG. 4*b* with a bottom portion of the bag folded up to lie against the middle portion of the bag with the bottom portion releasably secured in position by the securing flap.
FIG. 4*d* shows a view of the soft-sided container or tote bag of FIG. 4*c* in the folded configuration of FIG. 1*b;*

Container assembly 20 also has a set of fasteners, catches, and securements. Along the upper edge of the seam of flap 92 to free edge 62 are first and second, centrally located hook-and-eye strips 100, 102, that mates with corresponding hook-and-eye fabric patches or pads or strips 104, 106, located centrally at the meeting of zones or regions 82, 84 of first wall 24 and second wall 26, respectively. These fabric patches are supplied in male and female mating portions and are often sold under the brand name "Velcro" (t.m.). In the embodiment of FIG. 1*a*, and FIG. 4*b* strip 100 of the first or inside face of web 60 mates releasably with strip 104 of the first or outside skin 34 of first wall 24. In the inverted configuration of FIGS. 1*b* and 4*d*, strip 102 of the second or outside face of web 60 mates with strip 106 of outside skin 34 of second wall 26.

Figures 6A, 6B, 6C, 6D, 6E, 6F, 6G, 6H:
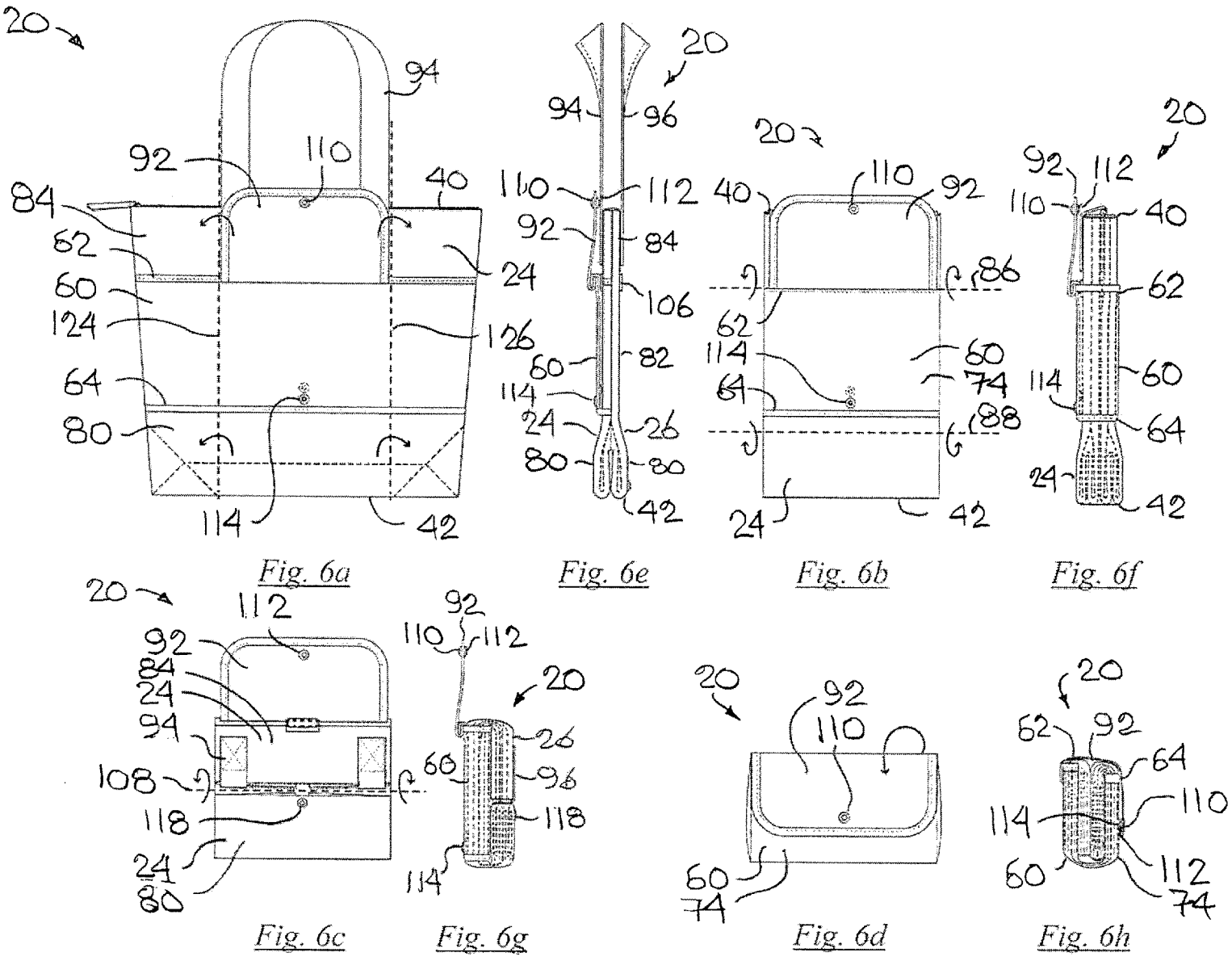
FIG. 6*a* shows a front view of the container assembly of FIG. 1*a* in its first configuration, flattened as in FIG. 4*b* with fold lines illustrating a first step in folding of the container assembly to a first variation of a collapsed carry pouch.
FIG. 6*b* shows a front view of the partially folded container assembly of FIG. 6*a* with fold lines illustrating a subsequent or second step of folding a top portion is folded downward and a bottom portion is folded upward over the back or rear surface of the bag to meet each other with the securing flap remaining in an upright or non-folded condition.
FIG. 6*c* shows a back or rear side view of the partially folded soft-sided insulated container assembly of FIG. 6*b* with a fold line illustrating a third step in folding into the carry pouch format, the bottom portion being folded upwards again to lies against the folded-down top portion.
FIG. 6*d* is a front view of the container assembly in the carry pouch format with a directional fold line illustrating the final step in the folding of the bag into the compact carry pouch, or purse, format.
FIG. 6*e* shows a right end view of the container assembly of FIG. 6*a;*
FIG. 6*f* shows a right end view of the container assembly of FIG. 6*b;*
FIG. 6*g* shows a right end view of the container assembly of FIG. 6*c;*
FIG. 6*h* shows a right end view of the container assembly of FIG. 6*d;*
Figures 7A, 7B, 7C, 7D, 7E, 7F, 7G, 7H:
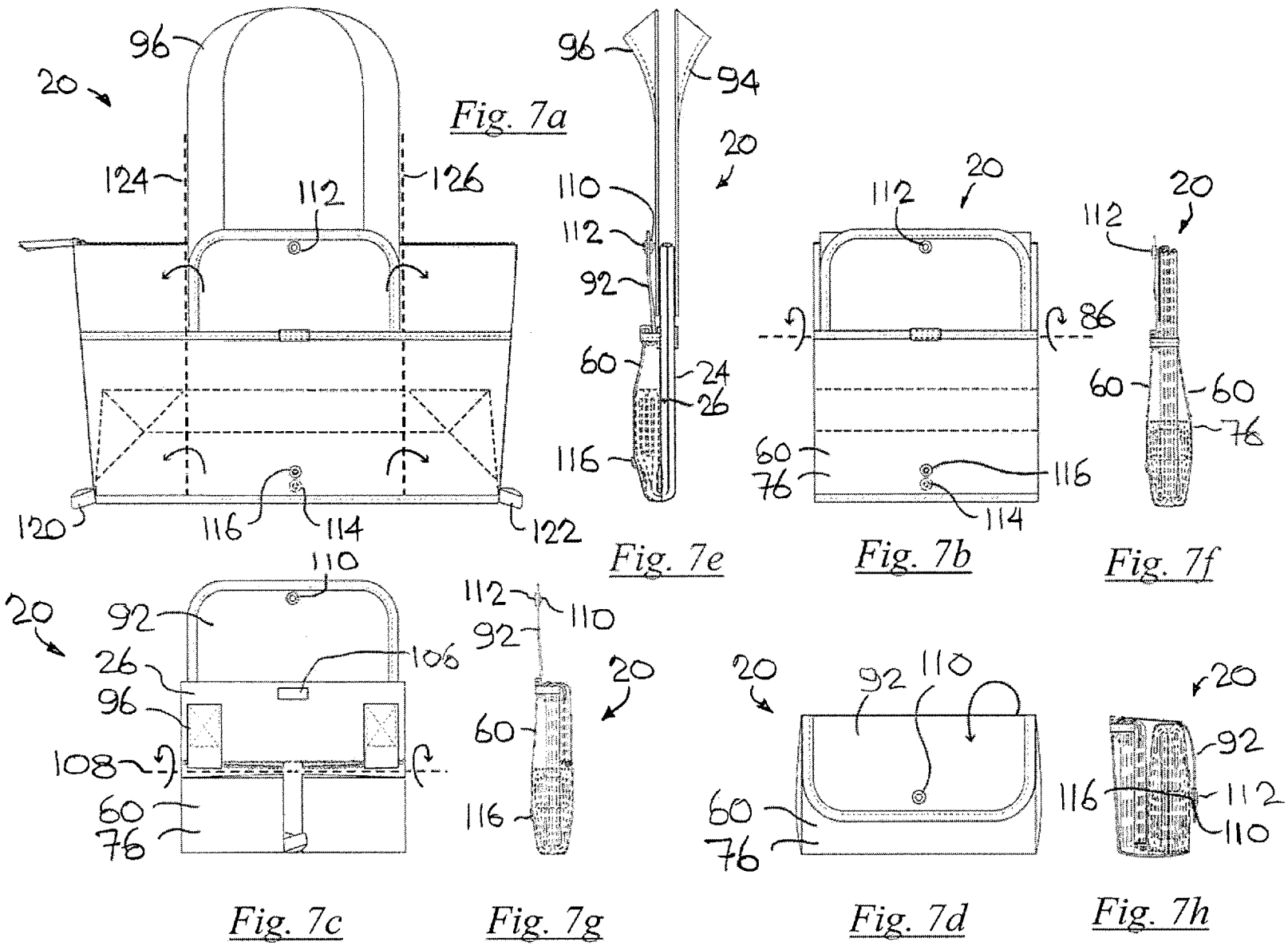
FIG. 7*a* is a front view of the container assembly of FIG. 1*b* in its partially expanded condition or second configuration as flattened condition with fold lines illustrating an initial or first step of folding.
FIG. 7*b* is a front view of the container assembly of FIG. 7*a* with a fold line illustrating a subsequent or second step of the folding.
FIG. 7*c* is a back view of the partially folded soft-sided insulated container assembly or bag of FIG. 7*b* with fold lines illustrating a subsequent or third step in folding.
FIG. 7*d* shows the final step in the folding of the partially expanded container assembly of FIG. 7*c* into the compact carry pouch format where the securing flap is folded downwards over the folded top and bottom portions of the tote bag and releasably secured in position.
FIG. 7*e* shows a right end view of the container assembly of FIG. 7*a;*
FIG. 7*f* shows a right end view of the container assembly of FIG. 7*b;*
FIG. 7*g* shows a right end view of the container assembly of FIG. 7*c*.
FIG. 7*h* shows a right end view of the container assembly of FIG. 7*d.*

Flap 52 has a releasable attachment fitting 110, facing inwardly, and a releasable attachment fitting 112 facing outwardly, both being located near the distal lip or margin of flap 52. A mating attachment fitting 114 is located near the lower edge of web 70, facing outward (in the configuration of FIG. 1*a*), and another fitting 116 is found inside pouch 70. Fitting 114 is between fitting 116 and lower margin 64. Fitting 116 faces inward (in the configuration of FIG. 1*a*). A further fitting 118 is mounted to second wall 26 near the seam with bottom wall 28. Fitting 118 faces outward, or is outwardly exposed in the configuration of FIG. 1*a*. These fitting are all in the same vertical plane, so that when the various parts move or fold, the fittings line up with each other. It is convenient that the vertical plane of these fittings be located on the vertical centerline, or vertical plane of symmetry, of container 20. Fittings 110, 112, 114, 116 and 118 may be releasable snap fittings, or snaps. It is arbitrary whether they are male or female. However, fittings 110, 112 are of the same gender, and fittings 114, 116 and 118 are of the opposite gender. In the embodiment illustrated, fittings 110 and 112 are male snap connectors; fittings 114, 116 and 118 are female snap connectors. In FIG. 4*c*, fitting 110 mates with fitting 118. In FIGS. 6*d* and 6*h*, fitting 112 mates with fitting 114. In FIGS. 7*d* and 7*h*, fitting 112 mates with fitting 116. Finally, the inside of pouch 70 has, in its bottom left hand and right hand corners, a pair of loops 120, 122 that may be used to aid in turning pouch 70 ins inside-out to its inverted condition.

To recap, container assembly 20 is foldable or collapsible from either a fully expanded deployed state, as in FIG. 1*a*, or from a partially expanded deployed state as in FIG. 1*b*. In each case, be it of FIG. 1*a* or of FIG. 1*b*, container assembly 20 defines an interior carrying space, or cavity, or chamber 56, which is seen in the first or fully deployed, unfolded, configuration of FIG. 1*a*, and in the second, or partially folded or partially collapsed, or half size configuration of FIG. 1*b*. That is, the size of chamber 56 in FIG. 1*b* is smaller than the size of chamber 56 as partially folded or stored in FIG. 1*a*. The term "half size" may be understood to mean that part of the bag wall structure has been folded to a condition in which the interior volume is reduced relative to the fully expanded configuration of FIG. 1*a*, whether that volume is precisely "one half" of the previous volume, or more or less. In either case, container assembly 20 defines an interior cavity, chamber 56, in which to store articles.

Furthermore, whether starting from the configuration of FIG. 1*a*, or starting from the configuration of FIG. 1*b*, container assembly 20 can be folded to another configuration in which it has, or defines, a carry pouch format or fully collapsed state (FIG. 6*d*, 6*h*; 7*d*, 7*h*) to facilitate compact storage of container assembly or bag 20. In those fully collapsed and folded conditions, positions, or configurations the interior cavity or chamber 56 is not accessible for use. More specifically, the container assembly or bag 20 is a folding bag or sack having a first configuration, as illustrated in the view of FIG. 1*a* wherein the container assembly or bag 20 is in its fully expanded state suitable for carrying objects contained therein; a second configuration, as illustrated in the view of FIG. 1*b* in which container assembly or bag 20 is in its partially expanded or second deployed state suitable for carrying a smaller quantity of objects, or smaller objects; and a third configuration seen in the views of FIGS. 6*d* and 7*d*, wherein the container assembly or bag 20 is in a fully collapsed state or fully folded carry pouch format, or purse format, in which interior cavity of chamber 56 is not available for storing articles.

In the first configuration or position or condition, or fully expanded state, the soft-sided, insulated, wall structure of container assembly or bag 20 defines a first interior cavity or chamber 56 that defines a first interior volume for storing articles. In the partially expanded or second deployed state, container assembly or bag 20 has a second interior volume, that second interior volume being less than, or being reduced relative to, the first interior volume. In some embodiments, for example, the first interior volume is about twice or two times the second interior volume. In the folded purse or carry pouch format, container assembly or bag 20 is folded down on itself into a compact form such that the interior cavity is not accessible.

In some embodiments, container assembly or tote bag 20, may have a wall structure indicated generally as 22. Wall structure 22 may be a soft-sided insulated wall structure. Referring now to FIG. 3, in some embodiments, for example, the wall structure 22 may include a front wall or first wall panel 24, a rear wall or second wall panel 26, and a bottom wall or bottom panel 28. The bag or container assembly 20, when unfolded, in either its fully expanded state or first configuration, or its partially expanded state or second configuration may have the form of a tote-bag, in which the side edge margins 44, 46 of front wall or first wall panel 24 and the edge margins 46, 44 of the rear wall or second wall panel 26 are joined together, typically at sewn seams. The bottom margin 42 of each of first and second wall panels 24, 26 extends around the periphery of about half of the bottom wall panel 28, e.g., one long side 48, and about one half of each of short side or end edge 50 of bottom wall panel 28, also typically at sewn seams. The upper margins or top edges 40 of first and second wall panels 24, 26 define between them opening 58 to interior cavity 56 and, in some embodiments, may be releasably joined together by way of a fastener, for instance a zipper closure as shown as closure fitting 54 in FIGS. 1*a* and 1*b*. While a zipper closure has been illustrated, it will be understood that, in other example embodiments, any suitable fastener may be used.

Referring now to FIGS. 2*a*-2*e*, folding container assembly 20 in its first configuration or fully expanded state will be described. In some embodiments, for example, the soft-sided container assembly or bag 20 includes generally trapezoidal left-hand and right hand side wall or end wall, or end wall portions 78 made of the combined folded side edge regions of first and second walls 24, 26, when container assembly or bag 20 is fully expanded, as seen when container assembly 20 is in its fully expanded or first configuration in FIG. 2*b*. The generally trapezoidal left-hand and right-hand side walls or end walls result from the wall panel structure and the soft-sided folding nature of the container assembly or bag 20. That is, the end walls 78 are each bounded by one half of a short edge 50 of bottom wall panel 28 at the bottom end of bag 20, and by a narrower top edge defined by an end of the zipper closure of fitting 54 (or other fastener) located at the top or upper end of the container assembly 20. The generally diagonal fold lines or edges of the generally trapezoidal walls 78 are formed where first and second wall panels 24, 26 bend toward one another at the respective corners of long edge 48 and short edge 50 of bottom panel 28. Thus each generally trapezoidal end wall 78 is made of a part of the material that forms the front wall or first wall panel material 24 and part of the material that forms the rear panel or second wall panel 26, each generally trapezoidal end wall having a vertical seam down the middle. In other embodiments the left and right-hand side walls or end walls may be formed from separate panels joined to the side margins or edges of first and second wall panels 24, 26.

While the left-hand and right-hand side walls or end walls 78 of the container assembly 20 have been described as being generally trapezoidal in shape in reference to the example embodiment illustrated in FIGS. 2*a*-2*e*, when the container assembly or bag is in its closed state, it will be understood that due to the soft-sided, folding nature of the bag the exact shape of the left-hand and right-hand side walls or end walls 78 of container assembly 20 may be somewhat fluid.

In the subject example, retaining web or conversion panel 60 extends across a portion of the outer surface skin 34 of front wall or first wall panel 24. Retaining web or conversion panel 60 extends across the width of first wall panel 24 from one side edge 44 of panel 24 to the other opposite side edge 46 of panel 24. It has a second side face 76 in face-to-face relationship with the outer surface of outer skin 34 of first wall panel 24 and a first, opposite, side face 74 facing away. A portion of the conversion panel or web 60 extends onto, or forms part of, the generally trapezoidal left and right-hand side or end walls 78.

When container assembly 20 is in its first configuration or fully expanded condition, retaining web or conversion panel 60 co-operates with front wall 24 to define interior cavity or pocket or pouch 70 between the inner surface or second side 76 of the conversion panel 60 and the outer surface of skin 34 of first wall panel 24. Outer surface or first side 74 of web 60 is remains visible on the exterior of container assembly or bag 20 when it is deployed in its first configuration. Given that it is arbitrary which is first or second, retaining web 60 may be disposed on first wall panel 24 or second wall panel 26.

Retaining web 60 is positioned relative to the outer skin 34 of first wall panel 24 such that it extends, generally across a generally middle region or middle portion 82 of the front or first wall panel 24. In some embodiments, retaining web or conversion panel 60 divides the container assembly or bag 20 into a top portion 84 corresponding to the portion of the first wall panel 24 and the second wall panel 26 that is disposed above the free upper edge 62 of web 60; and a bottom region or bottom portion 80 corresponding to the portion of the first wall panel 24 and the second wall panel 26 that is disposed below the bottom edge 64 of web 60.

A securing flap 92 extends from the upper or free edge 62 of web 60 and is attached or otherwise secured such that securing flap 92 is hingedly connected thereto to permit it to be moved between a first position lying outside pouch 70 in the fully expanded configuration. As such, a first side of securing flap 92 is in face-to-face relationship with the first side 74 of conversion panel or web 60 while a second, opposite side of securing flap 92 remains visible from the exterior of container assembly 20. It can be moved to a second position in which securing flap 92 is placed inside the pocket or pouch 70, such that the second side lies in face-to-face relationship against second side 76 of web 60 while the first side of securing flap 92 lies against the outer surface of skin 34 of first wall panel 24.

Securing flap 92 may have a releasable fastener or fasteners such as fittings 110, 112 which, in some embodiments, are, or include a first part of a snap assembly located on each of the first and second sides of securing flap 94, those parts 66 being configured for mating with a respective, corresponding second part of a snap assembly, such as one of a plurality of second parts 114, 116, 118 mounted to, or found on, different portions of the container assembly 20. When closed as seen in FIGS. 6*d* and 7*d*, container assembly 20 is seen secured in its compact carry pouch format.

In some embodiments, for example, the upper or free edge 62 of the web 60 may include a releasable securement 100, for example, a fabric hook-an-eye patch such as sold under the trade mark "Velcro" which cooperates with a corresponding fabric hook-an-eye patch, or corresponding releasable securement 104 mounted to the outer surface of skin 34 of first wall panel 24 for releasably securing the upper margin 62 of web 60 thereto. Pocket or pouch 70 is then in a closed condition. A second corresponding releasable securement 106 or fabric hook-an-eye patch is similarly disposed on the outer surface of skin 34 of second wall panel 26 for releasably securing releasable securement fitting 102 of free edge 62 of web 60 thereto such that the inverted pocket or pouch 70 is closed. While reference has been made to releasable securements in the form of corresponding fabric hook-an-eye patches, such as sold under the trade mark "Velcro". Other suitable releasable securements may be used.

In terms of construction, in some embodiments, front wall 24, bottom wall 28, and rear wall 26 may all be formed from a continuous strip of material, or layers of materials, as may be described below. Alternatively, front wall 24, bottom wall 28, and rear wall 26 may be cut from a developed blank of material, or layers of materials, and sewn or quilted together. This collapsible soft-sided, insulated wall structure assembly of body 22 forms the exterior wall of the container assembly or bag 20. The wall structure 22 may have several layers, such as external skin or layer 34, layer of thermal insulation 38, and internal skin or layer 36. The external skin may be a woven or other fabric skin. In some embodiments, for example, the external or outer skin may be a woven nylon cloth. It may be a scuff or abrasion resistant cloth. It may have a 150 Denier, or similar grade or thickness.

The folding and convertible nature of the container assembly or bag 20 will now be described in reference to FIGS. 4*a*-4*d*, FIGS. 5*a*-5*f*, FIGS. 6*a*-6*h* and FIGS. 7*a*-7*h*.

Figure 5B:
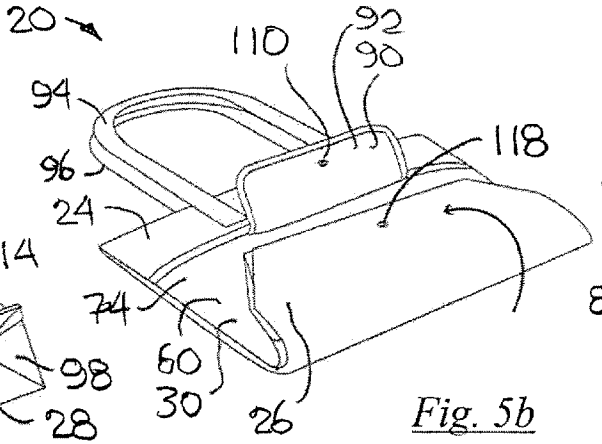
FIG. 5*b* shows the soft-sided container assembly or bag of FIG. 5*a* with a bottom portion of the bag folded up to lie against the middle portion.
Figure 5A:
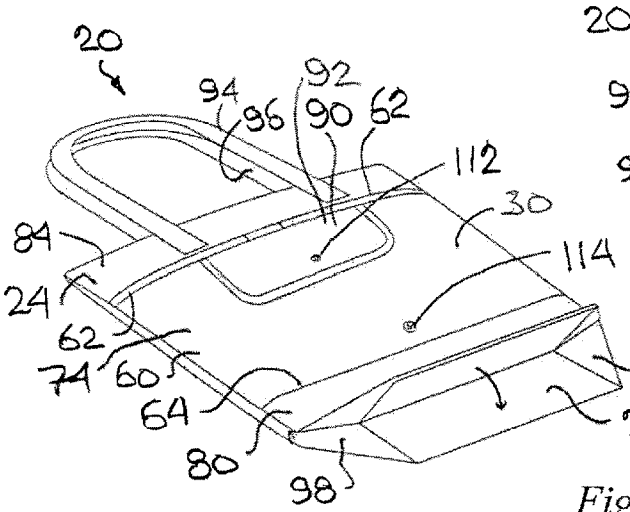
FIG. 5*a* shows a perspective view from above and to one side of the soft-sided container assembly or tote bag of FIG. 1*a* collapsed to lie flat with the bottom panel bi-folded into the retracted state as shown in FIG. 4*b;*
Figure 5C:
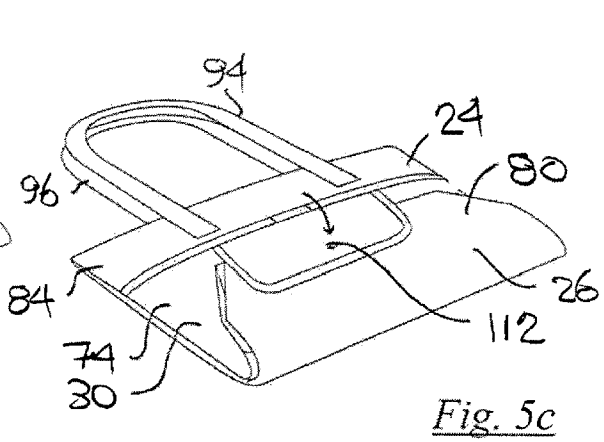
FIG. 5*c* shows the soft-sided container assembly or tote bag of FIG. 5*b* with the bottom portion releasably secured in position against the middle portion.
Figure 5D:
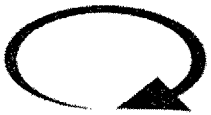
FIG. 5*d* shows the container assembly of FIG. 5*c* folded to the second configuration of FIG. 1*b* by inversion of the double-sided conversion panel with perspective reversed from FIG. 5*c;*
Figure 5D:
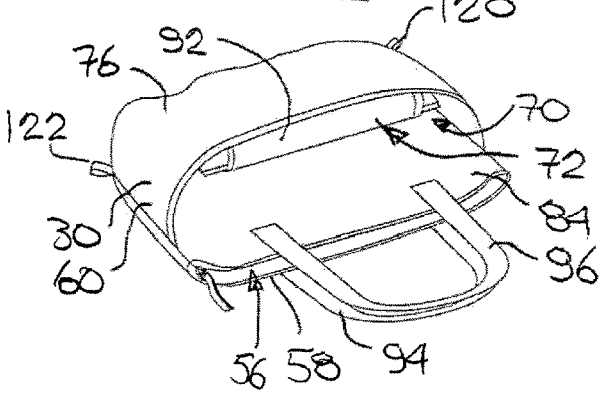
Figure 5F:
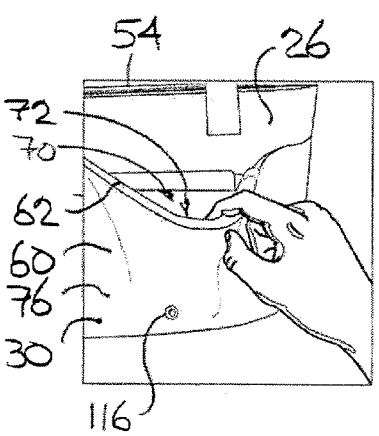
FIG. 5*f* shows an enlarged detail of FIG. 5*e;*
Figure 5E:
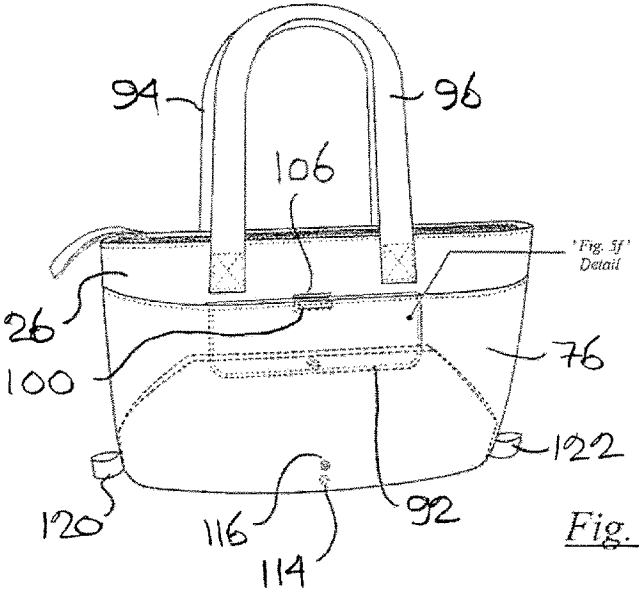
FIG. 5*e* shows a front perspective view of the container assembly of FIG. 5*e* in its second configuration, with an enlarged detail view of a portion of the double-sided conversion panel.

Referring to FIGS. 4*a*, 4*b* and FIG. 5*a*, the wall structure of body 22 of soft-sided container assembly 20 folds. End walls 78 may be bi-folded along a bottom portion of their vertical centerline or seam, as a corner folding flap or gusset 98 that folds inwardly as bottom wall 28 bi-folds upwardly along its centerline. When container assembly 20 folds in this manner, first and second wall panels 24, 26 move toward each other, and, as folded, lie in generally parallel, or substantially parallel, planes disposed one atop the other. This step of folding or collapsing the container assembly or bag may be considered the first or initial folding step when converting container assembly 20 from the fully expanded or first configuration into either the partially expanded or second configuration, or the fully collapsed or storage configuration of the third configuration, be it of FIG. 6*d* or FIG. 7*d*.

To convert container assembly 20 from the fully expanded condition to the partially expanded condition or second deployed state, bottom panel 28 is bi-folded along its longitudinal centreline as shown in the views of FIGS. 4*b* and 5*a*, such that first and second wall panels 24, 26 also being brought to lie flat and in parallel, or substantially parallel, planes one atop the other. In the next step, bottom portion 54 of container assembly 20 is folded upward, as indicated by the directional fold arrow included in FIG. 5*b*, such that outer surface skin 34 of bottom portion 80 of first wall panel 24 lies against first face 74 of web 60. At this point securing flap 94 may be used releasably to secure bottom portion 80 of container assembly 20 in this partially folded state seen in FIGS. 5*b* and 5*c* by bringing fastener 110 into releasable, mating relationship with corresponding fastener 118 of second wall panel 26 as shown in view of FIG. 4*c* and of FIGS. 5*b* and 5*c*. In this partially folded state, the folding of bottom portion 80 of container assembly 20 upwards defines a fold line 108 which effectively defines a reduced overall height of container assembly 20, the reduced overall height seen in FIG. 1*b* being less than the overall height seen in FIG. 1*a*. That reduced height is still greater than $h_{60}$ of web 60. That fold line eventually defines the bottom or base of container assembly 20 in its second configuration.

The next step is to invert or reverse pocket or pouch 70 such that first side 74 of web 60 lies face-to-face with outer skin 34 of second wall panel 26. By inversing, or reversing, pouch 70, a second, inside-out, configuration of pouch 70 is defined between outer skin 34 of second wall panel 26 and first face 74 of web 60. In some embodiments, since securing flap 94 is used to releasably the secure bottom portion 80 of the bag in its partially folded state of FIGS. 4*c* and 5*c*, securing flap 94 locates within the second configuration pouch 70 such that securing flap 94 is no longer visible from the exterior of container assembly or bag 20.

To assist with the inversion or reversing of pouch 70 about bottom edge 64 of web 60, loops 120, 122 at the bottom internal corners of pouch 70 may be used as finger loops or finger pulls to aid in ensuring that pouch 70 is completely inverted or reversed on itself about fold line 108 and bottom edge 64 to form the second, inside-out, configuration of pouch 70. The conversion of container assembly 20 from the fully expanded or first configuration to the partially expanded or second configuration is now complete, with the new bottom or base of container assembly 20 being defined by the sewn seam 64 of web 60 relative to first wall panel 24 such that the overall height of container assembly 20 corresponds to height, $h_{60}$, of web 60 plus the height of top portion 84 of container assembly 20 that extends between free or upper edge 62 of web 60 and upper edge margins 40 of first and second wall panels 24, 26. Partially folded first and second wall panels 24, 26 and sewn seam 64 of web 60 together define the second configuration internal cavity or chamber 56 of container assembly or bag 20. While the internal volume of the second configuration internal cavity 56 may be reduced as compared to the internal volume defined by the first configuration internal cavity, container assembly 20 still provides a main storage compartment in the form of internal cavity 56 as well as a side pouch 70 that is accessible on the outer surface or exterior of container assembly 20.

The conversion of container assembly 20 from its second configuration into its fully collapsed compact carry pouch format or third configuration will now be described in further detail with particular reference being made to views of FIGS. 7*a*-7*f*. To convert container assembly 20 from its partially expanded or second configuration into the fully collapsed, carry pouch format, or third configuration, securing flap 94 is released from its releasably secured position within pouch 70, such that it extends in an upright or non-folded position lying flat, or substantially flat, against outer skin 34 of second wall panel 26, as in FIG. 7*a*. From this position, carrying handle or carrying handle portions 94, 96 are folded back and downwards relative to upper edge margins 62, and zipper closure 54, and side sections or side portions 124, 126 of container assembly 20, as defined by the portions of bag 20 that extend laterally beyond a vertical axis defined by each of the edges of securing flap 92 or respective end edges of carry handle portions 94, 96, are folded backwards about respective vertical fold lines 108, as illustrated schematically in FIG. 7*a*, such that side sections or portions 124, 126 lie flat, or substantially flat, against outer skin 34 of first wall panel 24 with the side seams of bag 20 being brought together such that they are opposed, and may meet when folded at a central midline, or central vertical axis of bag 20 to arrive at the partially folded configuration of FIG. 7*b*. Securing flap 92 remains in its upright, non-folded position.

The next step is to fold top portion 84 of container assembly 20 backward and downward about upper fold line 86, as illustrated schematically in FIG. 7*b*, which fold line generally corresponds to upper free edge 62 of web 60 which partially folded configuration as viewed from the back is illustrated in FIG. 7*b* with a side view visible in FIG. 7*f*. From this partially folded configuration, bottom portion 80 of container assembly, as defined by the portion of container assembly that extends below folded down top portion 84 of bag 20 is folded upwards about lower fold line 88, seen in FIG. 7*c*, and FIG. 7*g* such that it lies overtop of the already folded down top portion 84, as seen in FIGS. 7*c* and 7*g* at which point securing flap 92 is folded downwards over the folded top and bottom portions 80, 84 of container assembly 20 in order to bring a first fastener 112 into mating relationship with a corresponding second fastener 116 on the folded-up bottom portion 80 of second wall 26 of container assembly 20, as shown in FIGS. 7*d* and 7*h*, wherein container assembly 20 has been collapsed into its compact carry pouch format or third configuration.

In some instances, a user may want to convert the container assembly 20 into the compact, carry pouch format or third configuration (or fourth configuration, if one considers that there are two, alternate, purse or carry pouch configurations) when the container assembly or bag 20 is in its fully expanded condition or first configuration of FIG. 1*a* without having first to convert bag 20 into the partially expanded condition or second configuration of FIG. 1*b*. The conversion process for converting container assembly 20 from its first configuration or fully expanded condition into the carry pouch format or third configuration of FIGS. 6*d* and 6*h*.

To convert container assembly 20 of FIG. 1*a* to the compact purse or carry pouch format of FIG. 6*d*, bottom panel 28 is bi-folded into two halves along its longitudinal centreline as before with the first and second wall panels 24, 26 being brought to lie flat and in parallel, or substantially parallel, planes one atop the other as illustrated in the view of FIG. 4*b*. From this flattened state, as in FIG. 6*a*, the securing flap 92 extends in an upright or non-folded position with the second side of the securing flap 92 lying flat, or substantially flat, against outer skin 34 of first wall panel 24 as in FIGS. 6*a* and 6*e*. From this position, the carrying handle or carrying handle portions 94, 96 are folded back and downwards relative to the upper edge margins 42, and zipper closure 54; and side sections 124, 126 of container assembly 20, as defined by the portions of bag 20 that extend laterally beyond respective vertical axes 86, 88 defined by the side edges of the securing flap 92 or respective ends of the carry handle portions 94, 96, are folded backwards about vertical fold lines 88, as illustrated in FIG. 6*b*, such that the side sections 124, 126 are brought to lie flat, or substantially flat, against the outer surface of second wall panel 26 with the side seams of bag 20 being brought together such that the edges are opposed. They may meet at a central midline, or central vertical axis of the bag 20 to arrive at the partially folded configuration illustrated in FIG. 6*b*. Securing flap 92 remains in its upright, non-folded position at this stage in the conversion process.

The next step in the conversion of the container assembly 20 is to fold top portion 84 backward and downward about fold line 86, as in FIG. 6*b*. Fold line 86 generally corresponds to upper free edge 62 of web 60. The bottom portion 54 of container assembly 20 is also folded back and upwards relative to lower fold line 88, which fold line is slightly below the bottom seam 64 of web 60 and its attachment to the first wall panel 24. Securing flap 92 remains in its upright, non-folded position.

The next step is to fold bottom portion 80 of the partially folded container assembly of FIG. 6*c* upwards about fold line 88, such that it lies over top of the folded down top portion 84. At this point, securing flap 92 is folded downward over the folded top and doubled folded bottom portions 80, 82 of container assembly 20 to bring a fastener 110 to mate with fastener 114, as shown in FIGS. 6*d* and 6*h*.

As such, container assembly 20 is converted into the fully collapsed compact, portable purse or carry pouch format or third configuration, independently, from either the fully expanded condition or first configuration of FIG. 1*a* or from the partially expanded or second configuration of FIG. 1*b*.

The features of the various embodiments may be mixed and matched as may be appropriate without the need for further description of all possible variations, combinations, and permutations of those features. The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by a purposive reading of the appended claims.

I claim:

1. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said first wall has an inside surface that faces said second wall, and an outside surface that faces said retainer;

said retainer has a first surface and a second surface;

in said first position, said first surface of said retainer faces said first surface of said first wall;

in said second position, said second surface of said retainer faces said first wall, and said first surface of said retainer faces outwardly and away from said first wall.

2. The soft-sided insulated container of claim 1 wherein, in said second position, said inside surface of said first wall faces toward said retainer, and said second wall is between said inside surface of said first wall and said retainer.

3. The soft-sided insulated container of claim 1 wherein said retainer is a web.

4. The soft-sided insulated container of claim 1 wherein said retainer is uninsulated.

5. The soft-sided insulated container of claim 1 wherein said retainer is a web mated to said first wall to define a reversible pouch.

6. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said retainer is a web mated to said first wall to define a reversible pouch; and in said second position, said pouch is in turned inside-out relative to the first position, and, when said pouch is turned inside-out, said bottom wall and at least a portion of said second wall are contained within said pouch.

7. The soft-sided insulated container of claim 6 wherein, in said second position, at least a portion of said first wall is also contained within said pouch.

8. The soft-sided insulated container of claim 6 wherein said bottom wall is a folding wall.

9. The soft-sided insulated container of claim 8 wherein said first wall and said second wall have respective lower margins distant from said closure, and, in said first position, said first wall projects onto said second wall, and said bottom wall is folded between said respective lower margins of said first and second walls.

10. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said container has a securement;

said soft-sided insulated container is foldable from said first position to a first folded storage configuration;

said soft-sided insulated container is foldable from said second position into a second folded storage configuration, said second folded storage configuration being different from said first folded storage configuration; and said securement is operable to hold said soft-sided insulated container in each of said first folded storage configuration and said second folded storage configuration.

11. The soft-sided insulated container of claim 10 wherein:

said retainer is a web extending from side to side of said first wall;

said web has a lowermost margin secured to said first wall, and an uppermost margin distant from said lowermost margin, said uppermost margin defining a free edge;

a pouch being defined between said web and said first wall;

said pouch being invertible to an inside-out position; and said securement has the form of a flap, said flap being secured to said free edge.

12. The soft-sided insulated container of claim 11 wherein:

in said first position, said soft-sided insulated container has the form of a first tote-bag configuration;

in said second position, said soft-sided insulated container has the form of a second tote-bag configuration, said second tote bag configuration being smaller than said first tote-bag configuration; and in each of said first folded storage position and said second folded storage position said flap being folded over said soft-sided insulated container, and said soft sided-insulated container having a purse-shaped configuration.

13. The soft-sided insulated container of claim 12 wherein, in said purse-shaped configuration, said side margins of said first wall are folded toward each other; and said soft-sided insulated container is folded over on itself four times in the direction of height; and said side margins of said first wall are concealed behind said flap.

14. The soft-sided insulated container of claim 13 wherein: said first wall has a height, H, from said lower margin thereof to said upper margin thereof; said web has a height, h, between said lower margin thereof and said upper margin thereof; and a ratio of h:H lies in the range of $2/5$ to $3/5$.

15. The soft-sided insulated container of claim 10 wherein said retainer is a web; said retainer is uninsulated; and said retainer is a web mated to said first wall to define a reversible pouch.

16. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said retainer is a web extending spanwise across said first wall and having a free edge, said free edge also extending spanwise;

in moving between said first position and said second position, said web is inverted; and said container has a securement mounted to said free edge of said web;

said container is foldable from said first position into a first folded storage position;

said container is foldable from said second position into a second folded storage position different from said first folded storage position; and said securement is operable to hold said soft-sided insulated container in each of said first folded storage position and said second folded storage position.

17. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said retainer is a web extending spanwise across said first wall and having a free edge, said free edge also extending spanwise;

said web is co-operable with said first wall to define a pouch;

said pouch is invertible;

in moving between said first position and said second position, said web is inverted; and said container has a first pouch securement and a second pouch securement mounted to said free edge of said web;

in said first position, said first pouch securement engages said first wall to close said pouch; and, in said second position said pouch is inverted, and said second pouch securement engages said second wall to close said pouch.

18. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said first wall and said second wall are joined along mutual side edges;

said retainer is a web extending spanwise across said first wall, and having corresponding side edges joined to said respective side edges of said first wall;

said first wall has an upper margin proximate said closure, and a lower margin distant from said closure;

said web has a lower margin that runs across said first wall, said lower margin of said web being spaced upwardly of said lower margin of said first wall;

said web has an upper margin that runs across said first wall, said upper margin of said web being spaced downwardly of said upper margin of said first wall; and said upper margin of said web being a free edge.

19. The soft-sided insulated container of claim 18 wherein: said first wall has a height, H, from said lower margin thereof to said upper margin thereof; said web has a height, h, between said lower margin thereof and said upper margin thereof; and a ratio of h:H lies in the range of ⅖ to ⅗.

20. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said closure has a lineal length L, said bottom wall has a length running transverse to said first wall, and a width running between said first wall and said second wall, said length of said bottom wall being greater than said width of said bottom wall; and said length of said closure is greater than said length of said bottom wall.

21. A soft-sided insulated container comprising:

a first wall, a second wall, a bottom wall, and a retainer;

said first wall, said second wall and said bottom wall being insulated walls;

said first wall being a front wall, said second wall being a rear wall;

said first wall, second wall, and bottom wall co-operating to define a chamber of a first capacity in which to place objects;

said chamber having a closure distant from said bottom wall;

said retainer being mounted to said first wall;

said retainer being located outside said chamber;

said first wall, second wall and bottom wall being foldable to a first position;

in said first position said first wall lies between said retainer and said second wall;

at least said bottom wall and at least a portion of said front wall and said rear wall being movable to a second position in which said bottom wall and at least a portion of said second wall lie between said retainer and said first wall; and in said second position said chamber of said soft-sided insulated container has a second capacity, said second capacity being smaller than said first capacity;

said first wall, said second wall and said bottom wall are insulated;

each of said first wall and said second wall includes an outside layer, an inside layer, and a layer of insulation captured between said inside layer and said outside layer;

said closure of said soft-sided insulated container is a tracked fastener running along said upper margins of said first wall and said second wall; said bottom wall is a bi-folding bottom wall; and said retainer is an un-insulated web, said web and said first wall having mutually mated side edges, said web and said first wall defining an inside-out invertible pouch.

* * * * *